US006739219B1

(12) United States Patent
Cuevas

(10) Patent No.: US 6,739,219 B1
(45) Date of Patent: May 25, 2004

(54) DAMAGED LIGHT BULB BASE EXTRACTOR

(76) Inventor: Michael F. Cuevas, 7923 W. Country Gables Dr., Peoria, AR (US) 85381

( * ) Notice: Subject to any disclaimer, the term of this patent is extended or adjusted under 35 U.S.C. 154(b) by 4 days.

(21) Appl. No.: 10/371,788

(22) Filed: Feb. 21, 2003

(51) Int. Cl.[7] ..... B25B 23/16

(52) U.S. Cl. ..... 81/53.1; 81/53.11; 81/53.12; 81/452; 81/453

(58) Field of Search ..... 81/53.1, 53.11, 81/53.12, 452, 453

(56) References Cited

U.S. PATENT DOCUMENTS

| | | | | | |
|---|---|---|---|---|---|
| 2,117,017 | A | | 5/1938 | Chadsey | |
| 2,516,650 | A | | 7/1950 | Shapiro et al. | |
| 3,898,896 | A | * | 8/1975 | Suhay | 81/441 |
| 4,144,785 | A | * | 3/1979 | von Langendorff | 83/685 |
| 4,485,701 | A | | 12/1984 | Hough | |
| 5,103,695 | A | | 4/1992 | Dolle et al. | |
| 5,371,658 | A | | 12/1994 | Christie | |
| 5,386,744 | A | * | 2/1995 | Garcia | 81/53.11 |
| 5,458,029 | A | | 10/1995 | Walsky | |
| 5,490,438 | A | | 2/1996 | Zupo et al. | |
| 5,829,324 | A | | 11/1998 | Secor | |
| 5,937,714 | A | * | 8/1999 | Sherman et al. | 81/53.1 |
| 6,260,442 | B1 | | 7/2001 | Bayat | |

* cited by examiner

*Primary Examiner*—Lee D. Wilson
*Assistant Examiner*—Alvin J. Grant
(74) *Attorney, Agent, or Firm*—John D. Lister

(57) ABSTRACT

A damaged light bulb base extractor has a generally cylindrical, resilient, expandable base-engaging member mounted on a handle member. With the base-engaging member sandwiched between compression plates, relative movement of the compression plates toward each other compresses and expands the base-engaging member diametrically to engage and grip the interior sidewall of a light bulb base for extraction from a socket. Relative movement of the compression plates away from each other permits the base-engaging member to return to its initial unexpanded state for removal from a light bulb base. Extendable ribs on the external sidewall surface of an expandable base-engaging member can be used as a sole means of expanding the diameter of a base-engaging member or in conjunction with the compression plates to expand the diameter of the base-engaging member.

15 Claims, 3 Drawing Sheets

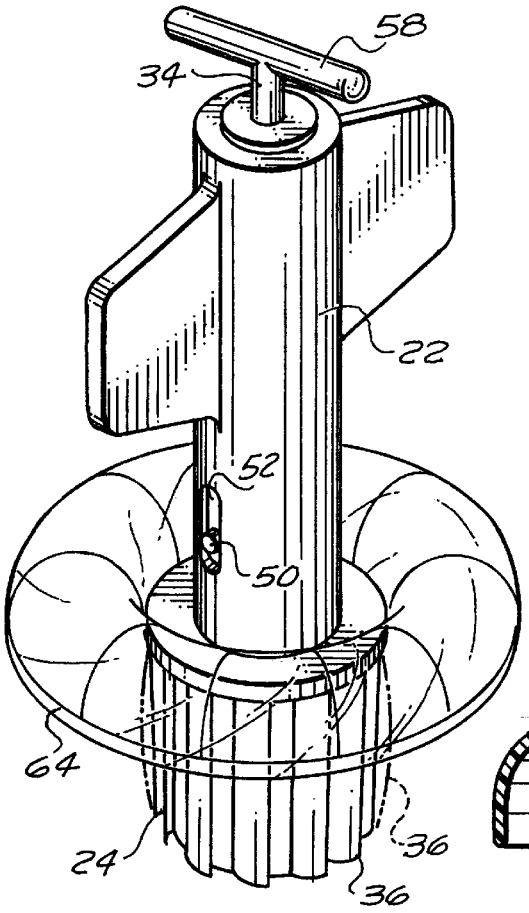
FIG. 1
FIG. 2
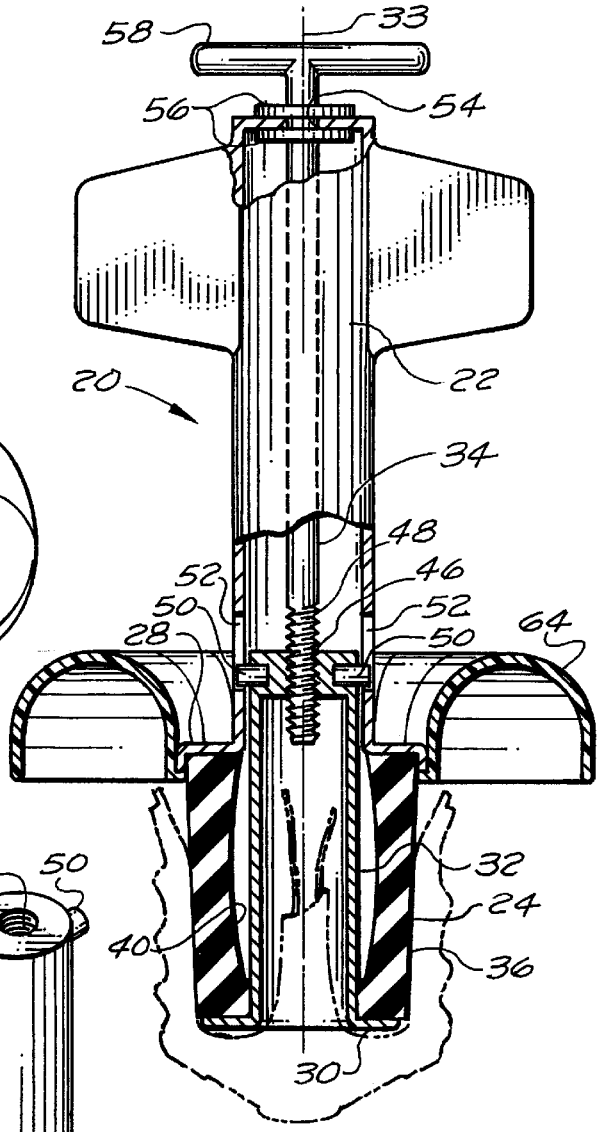
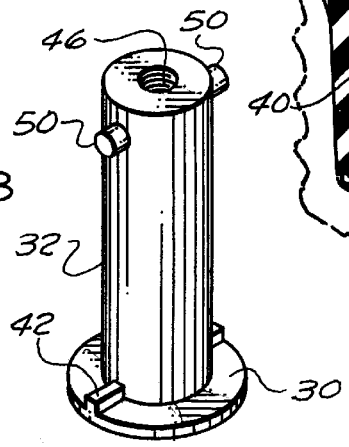
FIG. 3
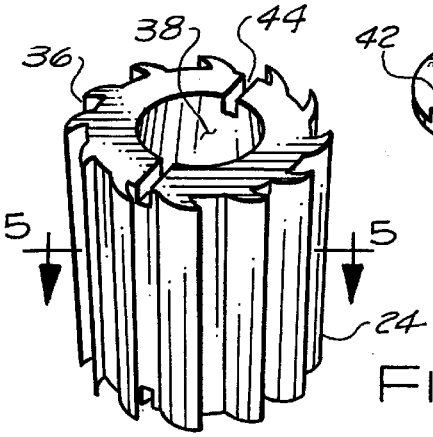
FIG. 4
FIG. 5
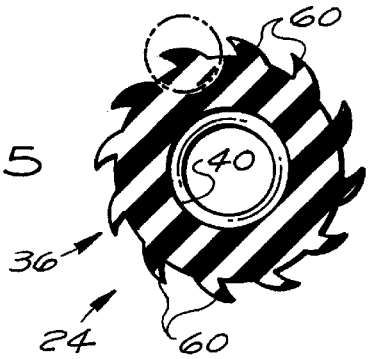

DAMAGED LIGHT BULB BASE EXTRACTOR

BACKGROUND OF THE INVENTION

The subject invention relates to a damaged light bulb base extractor and, in particular, to an improved damaged light bulb base extractor for engaging and gripping a base of a damaged light bulb so that the base can be easily, quickly and safely unthreaded from a light socket.

Numerous tools have been developed in the past for removing the bases of damaged light bulbs from light bulb sockets. The following patents, U.S. Pat. Nos. 2,516,650 (the "650 patent"); 5,371,658 (the "658 patent"); and 5,458,029 (the "029 patent"), disclose various expandable tools for extracting the bases of damaged light bulbs. The expandable tool of the 650 patent has a gripping member with a threaded, slotted, end portion 24 made up of a plurality of segments 22 and an operating member 14 with a conical end portion 32. When the conical end portion 32 of the operating member 14 is drawn down into the tool, the conical end portion 32 engages the insides of and expands the segments 22 of the slotted end portion 24 to grip the interior surface of a light bulb base. The slotted end portion 24 of the gripping member 12 is recessed at 62 to receive lamp components, e.g. lamp filaments. The 658 patent and the 029 patent disclose extractor tools wherein first and second handle members (handle members 11 and 12 of the 658 patent and handle members 14 and 16 of the 029 patent) are squeezed together to spread apart prongs (prongs 13 and 14 of the 658 patent and prongs 18 and 20 of the 029 patent) that grip the interior surface of a light bulb base. In FIGS. 7 and 8 of the 658 patent a transparent semi-spherical bowl 32 is provide to catch debris from a light bulb.

The following patents, U.S. Pat. Nos. 2,117,017 (the "017 patent); 4,485,701 (the "701 patent); 5,103,695 (the "695 patent"); 5,490,438 (the "438 patent"); 5,829,324 (the "324 patent"); and 6,260,442 (the "442 patent"), disclose various additional extractor tools for removing the bases of damaged light bulbs. These extractor tools are equipped with base-engaging members or end portions made of resilient rubber materials. The base-engaging members or end portions of these tools are inserted or forced into the base portion of a damaged lamp and, due to the resilient nature of the base-engaging members or end portions, these base-engaging members or end portions grip the interior of the lamp base portions so that the base portions can be unthreaded from a light socket. Except for the extractor tool of the 324 patent, these tools have a hollow core for receiving the filament of a damaged light bulb. The extractor tools of the 438 patent and the 324 patent are provided with shields or collars to catch debris from damaged light bulbs and it appears that handles of various lengths can be used with most of these tools to enable the operator to reach the light sockets.

SUMMARY OF THE INVENTION

While the above tools may be used to remove the bases of damaged light bulbs from light sockets, the damaged light bulb extractor of the subject invention provides an improved easy to use and inexpensive tool for removing the bases of damaged light bulbs from light sockets. The damaged light bulb extractor of the subject invention may be used to extract or remove the bases of damaged light bulbs of various types and sizes from light sockets. For example, the damaged light bulb extractor of the subject invention may be used to remove the bases of damaged industrial light bulbs, commercial light bulbs, street light bulbs, common household light bulbs, etc. from light sockets.

The damaged light bulb base extractor of the subject invention includes an expandable base-engaging member that can be easily inserted into the base of a broken light bulb and expanded to grip the interior sidewall surface of the light bulb base so that the light bulb base can be rapidly unthreaded and extracted from a light socket. In one embodiment of the subject invention, the expandable base-engaging member of the damaged light bulb base extractor is a generally cylindrical member made of a resilient material. The expandable base-engaging member is mounted on one end of a handle member and is sandwiched between first and second compression plates. The first compression plate is located on the end of the handle member at a first end of the expandable base-engaging member and the second compression plate is located at a second end of the expandable base-engaging member. The second compression plate is drawn toward the first compression plate at the end of the handle member to compress the expandable base-engaging member axially and expand the expandable base-engaging member diametrically to engage the interior sidewall of a light bulb base and grip the base for extraction from a light socket. The second compression plate is moved away from the first compression plate to permit the expandable base-engaging member to return to its initial unexpanded state for removal from a light bulb base after the base has been extracted from a light socket. In one preferred form of this embodiment, the expandable base-engaging member is a generally cylindrical, tubular member and the first and second compression plates are moved axially relative to each other by a threaded drive rod that passes from the handle into the threaded end of a tubular connecting rod that passes through the expandable base-engaging member and is integral with or affixed to the second compression plate. The threaded tubular rod forms a hollow axially extending core in the expandable base-engaging member to accept any portion of a light bulb filament and support structure remaining attached to the base of the damaged light bulb.

In use, the expandable base-engaging member is expanded to grip an interior sidewall surface of a damaged light bulb base by inserting the expandable base-engaging member into the base of a damage light bulb and effecting relative movement of the compression plates toward each other to compress the expandable base-engaging member axially and increase the outside diameter of the expandable base-engaging member. After the base of a damaged light bulb has been unthreaded and removed from a light socket, relative movement of the compression plates away from each other is effected to permit the resilient expandable base-engaging member to return to its initial outside diameter so that the expandable base-engaging member can be removed from the base of the damaged light bulb.

While the generally cylindrical external surface of the expandable base engaging sidewall may be smooth, the external sidewall surface of the expandable base-engaging member may includes a plurality of ribs that may be extended from first retracted positions to second extended positions. The ribs are maintained in the first retracted positions or are returned to the first retracted positions for insertion into or removal from a light bulb base by rotating the expandable base-engaging member in a clockwise direction relative to a light bulb base when inserting the expandable base-engaging member into or removing the expandable base-engaging member from a light bulb base. The ribs are extended from the first retracted positions to the second extended positions through a counterclockwise rotation of the expandable base-engaging member relative to a light bulb base while the expandable base-engaging member is inserted within a light bulb base to better grip the interior sidewall surface of a light bulb base for unthreading the light bulb base from a light bulb socket. While this structure and method of expanding the expandable base-engaging member may be used in conjunction with the axially compressible expandable base-engaging member described above, this structure for and method of expanding an expandable base-engaging member through the use of extendable ribs on the external sidewall surface of the expandable base-engaging member also can be used as a sole means of expanding the diameter of an expandable base-engaging member to grip a light bulb base for removal of the base from a light socket.

The handle of the damaged light bulb extractor may include an extension pole and a shield may be included to catch debris, e.g. broken glass, which may fall from a damaged light bulb base while it is being removed from a light bulb socket.

BRIEF DESCRIPTION OF THE DRAWINGS

FIG. 1 is a perspective view of a first embodiment of the damaged light bulb base extractor of the subject invention with the expandable base-engaging member of the extractor shown in an unexpanded state in solid line and in an expanded state in phantom line.

FIG. 2 is a side view, partially in section, of the base extractor of FIG. 1 inserted into the base of a damaged light bulb that is shown in phantom line.

FIG. 3 is a perspective view of a tubular connecting rod and compression plate used in the base extractor of FIG. 1.

FIG. 4 is a perspective view of an expandable base-engaging member of the base extractor of FIG. 1.

FIG. 5 is a transverse cross section through the expandable base-engaging member taken substantially along lines 5—5 of FIG. 4.

DESCRIPTION OF THE PREFERRED EMBODIMENTS

Figure 6:
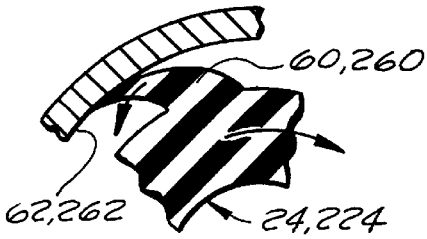
FIG. 6 is an enlarged view of the circled portions of FIGS. 5 and 14 schematically showing the ribs on the exterior surface of the expandable base-engaging member being retained in a non-extended state by the clockwise rotation of the expandable base-engaging member relative to a confining cylindrical surface.

FIGS. 1 to 7 show a first embodiment 20 of the damaged light bulb base extractor of the subject invention for removing a base of a damaged light bulb from a light bulb socket. The damaged light bulb base extractor includes a handle member 22; an expandable base-engaging member 24 for engaging and gripping an interior surface of a base of a damaged light bulb; and an actuating mechanism for expanding the expandable base-engaging member 24 that includes first and second compression plates 28 and 30, a connecting rod 32, and a drive rod 34.

The handle member 22 is tubular and may be made of a rigid, durable material such as but not limited to a polypropylene or other polymeric material, a fiberglass reinforced polypropylene or other fiberglass reinforced polymeric material, or stainless steel, aluminum or a similar durable metal. The expandable base-engaging member 24 may be made of a deformable and resilient polymeric material, such as but not limited to a deformable, resilient thermoplastic rubber or polymeric material, which has the resilience to return to its original diameter and shape when the expandable base-engaging member 24 is not under compression. Preferably, the material forming the expandable base-engaging member 24 is also durable and chemical resistant. Preferably, the first and second compression plates 28 and 30, the connecting rod 32, and the drive rod 34 of the actuating mechanism are made of stainless steel.

The handle member 22 has a first end and a second end. The expandable base-engaging member 24 is mounted on the second end of the handle member 22 to rotate with the handle member about a common central axis 33 extending through the handle member 22 and the expandable base-engaging member 24. The resilient, expandable base engaging member 24 has a generally cylindrical external sidewall surface 36 with a first end and a second end or has a generally cylindrical external sidewall that is slightly tapered from the first to the second end and the common central axis 33 extends through the expandable base-engaging member from the first end to the second end of the expandable base-engaging member. With its resiliency, the application of compressive forces to the expandable base-engaging member 24 in the direction of the common central axis 33 deforms and expands the external sidewall of the expandable base-engaging member diametrically from an unexpanded state (solid line in FIG. 1) to an expanded state (phantom line in FIG. 1) in a direction perpendicular to the common central axis 33 and release of the compressive forces returns the expandable base-engaging member 24 to the unexpanded state. The expandable base-engaging member 24 may be solid except for an opening 38 passing through the expandable base-engaging member from the second compression plate 30 to the first end of the expandable base-engaging member 24 that is sized to accommodate the connecting rod 32. However, preferably, the interior sidewall surface 40 of the opening 38 in the expandable base-engaging member is generally concave between the first and second ends of the expandable base-engaging member and the sidewall of the expandable base-engaging member is thinnest at a midportion generally midway between the first and second ends of the expandable base engaging member to facilitate the outward deformation of the resilient, expandable base-engaging member at its midportion to increase the diameter of the expandable base-engaging member for engaging an interior surface of a light bulb base.

The first end of the expandable base-engaging member 24 is contained by the first compression plate 28 that is mounted on or integral with the second end of the handle member 34. The second end of the expandable base-engaging member 24 is contained by the second compression plate 30 which may abut the end of the expandable base-engaging member or be embedded within the expandable base-engaging member adjacent the second end of the expandable base-engaging member. The expandable base-engaging member 24 is adhesively bonded to or otherwise secured to the first and second compression plates 28 and 30 to rotate with the compression plates and one or both compression plates may have ribs 42 embedded into notches 44 at the ends of the expandable base-engaging member. While the connecting rod 32 connecting the second compression plate 30 to the drive rod 34 may be solid, preferably, the connecting rod 32 is tubular and sized to accommodate filaments or other core components of a damaged light bulb still attached to the base when the expandable base engaging member is inserted into the base of a damaged light bulb to remove the base from a socket. The first end wall of the connecting rod 32 includes a threaded opening 46 therein aligned with the common central axis 33 for receiving the threaded second end 48 of the drive rod 34 which passes through the opening 46. The first end of the connecting rod 32 is also provided with a pair of pins 50 received within longitudinally extending slots 52 of the handle member 22 or is otherwise secured to the handle member 22 to permit movement of the connecting rod 32 in the direction of the common central axis 33 relative to the handle member 22, but to prevent relative rotation between the handle member 22 and the connecting rod 32. The drive rod 34 passes from the opening 46 in the first end of the connecting rod 32 through the interior of the tubular handle member 22 and out through an opening 54 in the first end of the handle member 22. The drive rod 32 is rotatably received within the opening 54 but restrained from axial movement relative to the handle member 22 by the stop or lock rings 56 so that the drive rod 34 can rotate relative to the handle member 22 and the connecting rod 32 to move the connecting rod 32 along the common central axis 33 so that the second compression plate 30 can be moved in the direction of the common central axis toward and away from the first compression plate 28. By turning the hand grip 58 on the drive rod 34 clockwise and threading the drive rod into the connecting rod 32, the first and second compression plates 28 and 30 are moved toward each other and compressive forces are exerted by the first and second compression plates 28 and 30 on the expandable base-engaging member 24 to cause the external sidewall 36 of the expandable base-engaging member 24 to expand diametrically for engaging and gripping an interior surface of a base of a damaged light bulb so that the base may be unthreaded from a light socket. By rotating the hand grip 58 of the drive rod 34 counterclockwise and unthreading the drive rod 34 from the connecting rod, the first and second compression plates 28 and 30 are moved away from each other, the compressive forces exerted by the first and second compression plates 28 and 30 on the expandable base-engaging member 24 are released, and the expandable base-engaging member returns to the unexpanded state to enable removal of the expandable base-engaging member from a base of a damaged light bulb after the base has been removed from a light socket.

Figure 7:
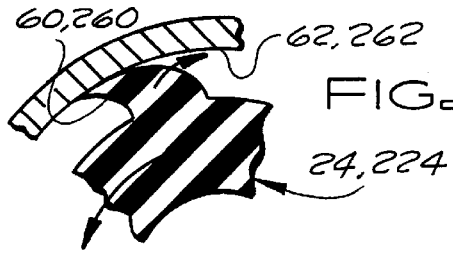
FIG. 7 is an enlarged view of the circled portions of FIGS. 5 and 14 schematically showing the ribs on the exterior surface of the expandable base-engaging member being extended by the counterclockwise rotation of the expandable base-engaging member relative to a confining cylindrical surface.
Figure 8:
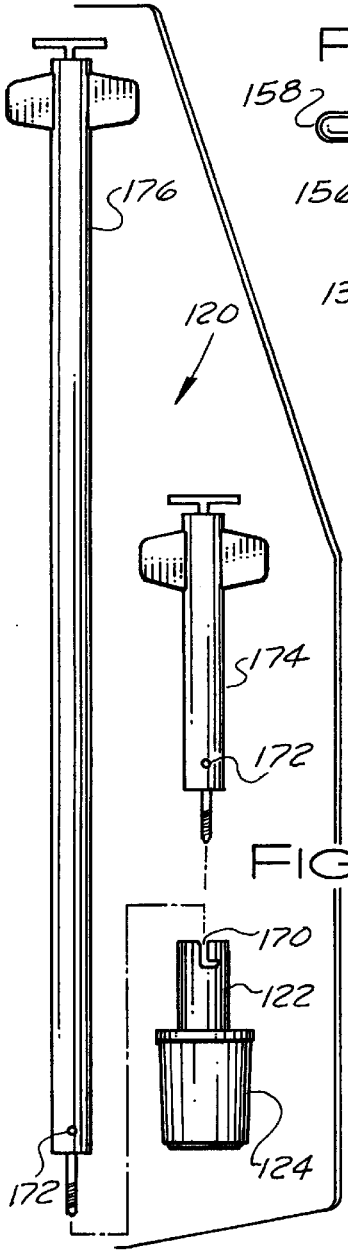
FIG. 8 is a side view of a three-piece version of the damaged light bulb base extractor of the subject invention.
Figure 9:
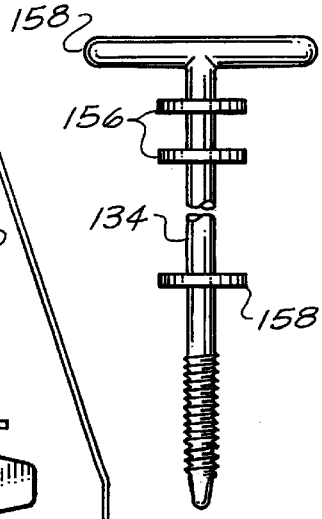
FIG. 9 is a side view, with a portion broken away, of a drive rod of the three-piece base extractor of FIG. 8.
Figure 10:
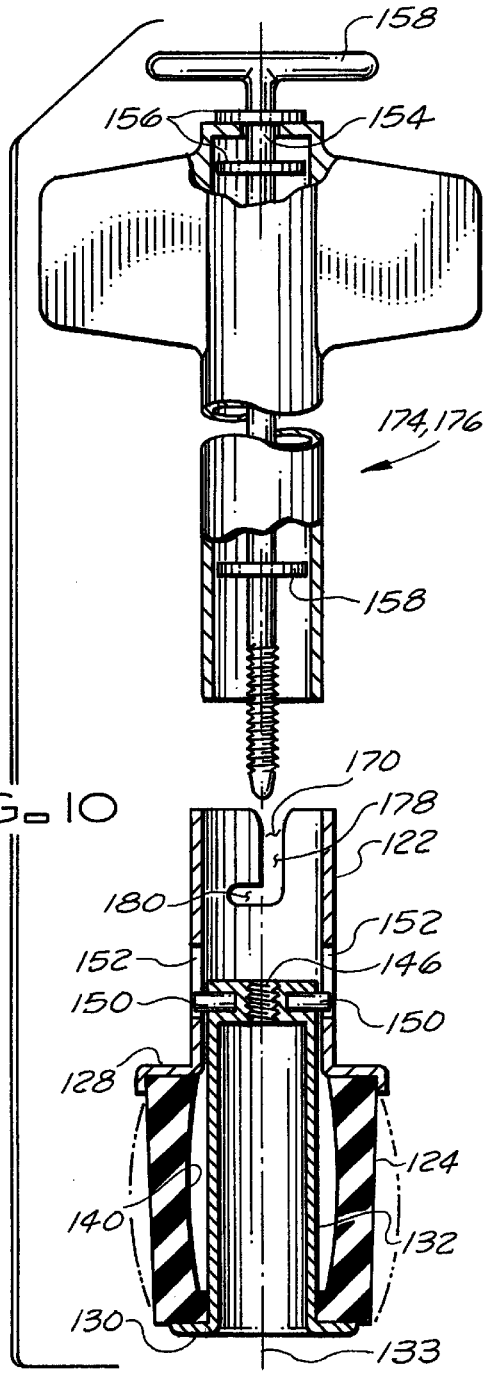
FIG. 10 is an exploded side view of the drive rod assembly, handle extension, handle member, and expandable base-engaging member of FIG. 8 with portions broken away and portions in section. In this figure, the exterior sidewall surface of the expandable base-engaging member has a generally smooth cylindrical surface without ribs. The expandable base-engaging member is shown in an unexpanded state in solid line and in an expanded state in phantom line.
Figure 11:
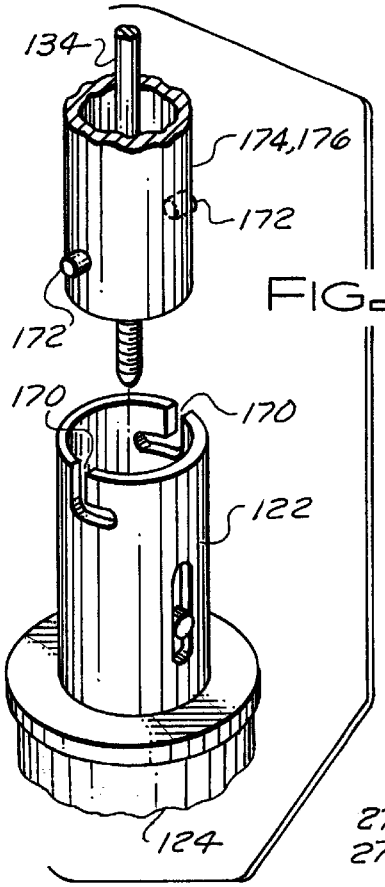
FIG. 11 is an exploded partial perspective view of one end of the drive rod assembly and handle extension and the handle member of the three-piece base extractor of FIG. 8.

While the external surface 36 of the expandable base-engaging member 24 may be generally smooth if desired, as shown in FIGS. 1, 2, and 4 to 7, the external surface 36 of the expandable base-engaging member 24 has a series of resilient ribs 60 thereon extending generally in the direction of the common central axis 33 from the first end to the second end of the expandable base-engaging member 24. The resilient ribs 60 have surface configurations whereby clockwise rotation of the expandable base-engaging member 24 with the ribs in contact with a confining generally cylindrical surface 62 of a light bulb base causes the ribs 60 to remain in a non-extended position or even move inward to facilitate such clockwise rotation of the expandable base-engaging member relative to the confining generally cylindrical surface 62 for insertion of the expandable base-engaging member into a light bulb base and counterclockwise rotation of the expandable base-engaging member 24 with the ribs in contact with a confining generally cylindrical surface 62 of a light bulb base causes the ribs 60 to move radially outward to extended positions in tighter contact with the confining generally cylindrical surface 62 of the light bulb base to better grip the confining generally cylindrical surface and facilitate the rotation of a light bulb base with the confining generally cylindrical surface 62 along with the expandable base-engaging member 24 for removal of a light bulb base gripped with the expandable base-engaging member. As shown in FIGS. 5 to 7, the ribs 60 are tapered from their bases to their free ends and project outwardly and in a counterclockwise direction from the exterior surface 36 of the expandable base-engaging member. With this structure, as the expandable base-engaging member 24 is rotated clockwise in the direction shown in FIG. 6, the frictional forces generated by the movement of the ribs along interior surface 62 of the light bulb base and exerted on the outer surfaces of the ribs 60 by the interior surface 62 of the light bulb base tend to flex, move or collapse the ribs radially inward toward the exterior surface 36 of the expandable base-engaging member to facilitate insertion of the expandable base-engaging member into the base. As the expandable base-engaging member 24 is rotated counterclockwise in the direction shown in FIG. 7, the frictional forces generated by the movement of the ribs along interior surface 62 of the light bulb base and exerted on the outer surfaces of the ribs 60 by the interior surface 62 of the light bulb base tend to flex or move the ribs outward away from the exterior surface 36 of the expandable base-engaging member to expand the expandable base-engaging member into tighter engagement with the interior surface 62 of the light bulb base.

As shown in FIGS. 1 and 2, the damaged light bulb extractor 20 may include a an annular debris shield 64 mounted on the handle member 22 adjacent the second end of the handle member and extending radially outward from the handle member 22 to catch broken light bulb pieces loosened while removing a base of a damaged light bulb from a light bulb socket and shielding an operator from such broken light bulb pieces. Preferably, the annular debris shield 64: is snap fitted onto or otherwise releasably mounted on the handle member 22 so that the annular debris shield may be removed from the handle member; made of a transparent polymeric material so that the base of a damaged light bulb can be viewed through the annular debris shield while it is being unthreaded from a socket; and has a generally concave annular surface facing away from the first end of the handle member for catching and retaining broken light bulb pieces.

FIGS. 8 to 11 show a three-piece version of the damaged light bulb extractor 20 of FIGS. 1 to 7 with an expandable base-engaging member 124 that has a smooth exterior surface without ribs. In this version 120 of the damaged light bulb extractor, the expandable base-engaging member 124, the connecting rod 132, and the connection of the connecting rod 132 to the second end of the handle member 122 with the pins 150 in the slots 152 are same as the expandable base-engaging member 24, the connecting rod 32, and the connection of the connecting rod 32 to the second end of the handle member 22. However, the first end of handle member 122 is provided with a pair of L-shaped slots 170 to receive the pins 172 mounted on the second ends of either a short 174 or long 176 handle extension to enable the damaged light bulb extractor 120 to be used for both close, easily accessible and more distant, relatively inaccessible light bulb sockets. The L-shaped slots 170 have first and second segments 178 and 180 with the second segments 180 extending in a counterclockwise direction from the first segments 178 so that the pins 172 of the handle extension 174 or 176 are locked within the slots 170 of the handle member 122 when the handle extension 174 or 176 is inserted into the handle member 122 and turned counterclockwise to remove a light bulb base from a socket.

The handle extensions 174 and 176 only differ in length with the handle extension 174 typically being about one to two feet in length and the handle extension 176 typically being about three or more feet in length. Each handle extension is tubular with a first end and a second end, is made of a rigid durable material like the handle member 22, and houses a drive rod 134 that is preferably made of stainless steel. A first end of the drive rod 134 passes through and is rotatably retained in an opening 154 in the first end of handle extension 174 or 176. The drive rod 134 is restrained from axial movement along the common central axis 133 of the extractor 122 by locking rings 156 on either side of the opening in the first end of the handle extension. In addition, a spacing ring 182 is located adjacent the second end of the handle extension to keep the drive rod 134 centered along the common central axis 133.

In operation the second end of the selected handle extension 174 or 176 is inserted into the first end of the handle member 122 and the threaded end of the drive rod 134 is threaded into the threaded opening 146 in the first end of the connecting rod 132. The pins 172 on the second end of the handle extension are inserted into the slots 170 of the handle member 122. With the damaged light bulb base extractor 120 thus assembled, the damaged light bulb base extractor 120 can be operated in the same manner as the damaged light bulb base extractor 20. By turning the hand grip 158 on the drive rod 134 clockwise and threading the drive rod into the connecting rod 132, the first and second compression plates 128 and 130 are moved toward each other and compressive forces are exerted by the first and second compression plates 128 and 130 on the expandable base-engaging member 124 to cause the external sidewall surface 136 of the expandable base-engaging member 124 to expand diametrically for engaging and gripping an interior surface of a base of a damaged light bulb so that the base may be unthreaded from a light socket. By rotating the hand grip 158 of the drive rod 134 counterclockwise and unthreading the drive rod 34 from the connecting rod, the first and second compression plates 128 and 130 are moved away from each other, the compressive forces exerted by the first and second compression plates 128 and 130 on the expandable base-engaging member 124 are released, and the expandable base-engaging member returns to the unexpanded state to enable removal of the expandable base-engaging member from a base of a damaged light bulb after the base has been removed from a light socket. While the expandable base-engaging member 124 shown does not include ribs on its external surface, the expandable base-engaging member 124 may have ribs such as those shown in FIGS. 1, 2, and 4 to 7.

Figure 12:
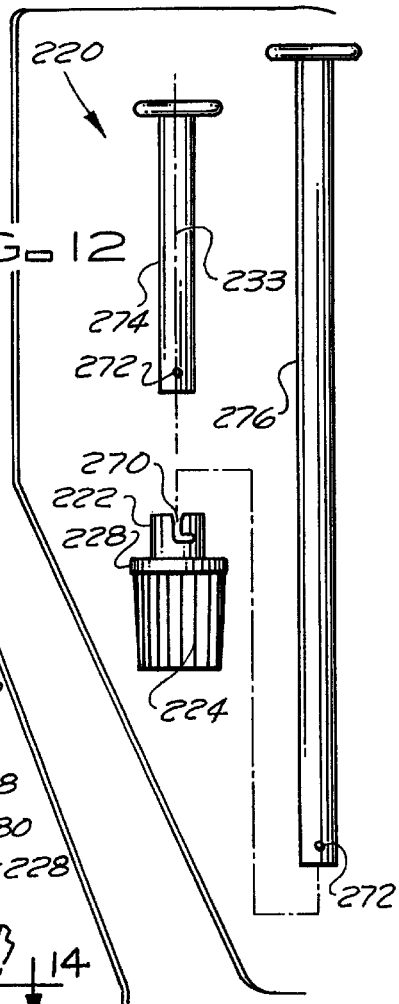
FIG. 12 is an exploded side view of another embodiment of the damaged light bulb extractor of the subject invention.
Figure 13:
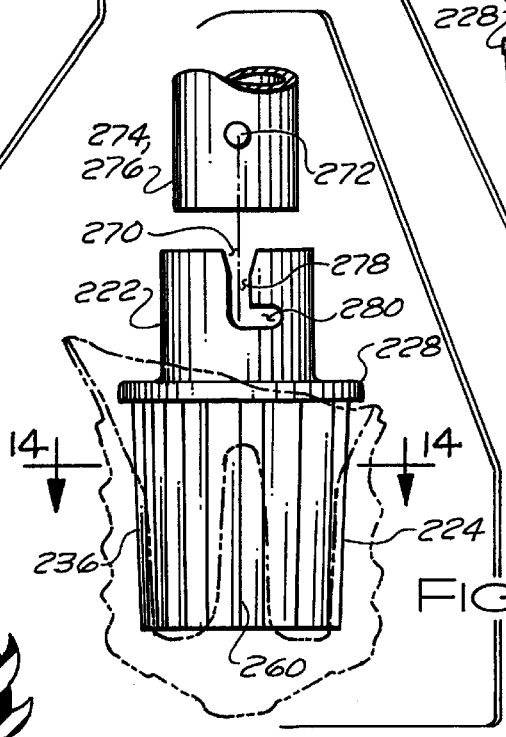
FIG. 13 is a side view of the damaged light bulb extractor of FIG. 12 with a partial view of an end of a handle extension and the expandable base-engaging member of the extractor inserted into a base of a damaged light bulb shown in phantom line.
Figure 14:
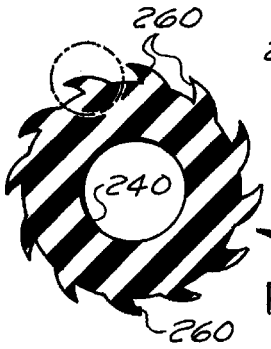
FIG. 14 is a transverse cross section, taken substantially along lines 14—14 of FIG. 12, through the expandable base-engaging member of the damaged light bulb base extractor of FIG. 13.

FIGS. 12 to 14 show another embodiment 220 of the damaged light bulb base extractor of the subject invention for removing a base of a damaged light bulb from a light bulb socket. The damaged light bulb base extractor 220 includes a handle member 222; an expandable base-engaging member 224 for engaging and gripping an interior surface of a base of a damaged light bulb; and a handle extension 274 and/or 276. The first end of the handle member 222 has a pair of L-shaped slots 270 to receive a pair of pins 272 mounted on the second ends of either handle extension 274 or 276 to enable the damaged light bulb extractor 220 to be used for both close, easily accessible and more distant, relatively inaccessible light bulb sockets. The L-shaped slots 270 have first and second segments 278 and 280 with the second segments 280 extending in a counterclockwise direction from the first segments 278 so that the pins 272 of the handle extension 274 or 276 are locked within the slots 270 of the handle member 222 when the handle extension 274 or 276 is inserted into the handle member 222 and turned counterclockwise to remove a light bulb base from a socket. A first end of the resilient expandable base-engaging member 224 is adhesively bonded or otherwise affixed to the end plate 228 on the second end of the handle member 222 to rotate with the handle member 222.

The handle member 222 is tubular and may be made of a rigid, durable material such as but not limited to a polypropylene or other polymeric material, a fiberglass reinforced polypropylene or other fiberglass reinforced polymeric material, or stainless steel, aluminum or a similar durable metal. The expandable base-engaging member 224 may be made of a deformable and resilient polymeric material, such as but not limited to a deformable, resilient thermoplastic rubber or polymeric material, which has the resilience to return to its original diameter and shape when the expandable base-engaging member 224 is not under compression. Preferably, the material forming the expandable base-engaging member 224 is also durable and chemical resistant.

The resilient expandable base-engaging member 224 has an external sidewall surface 236 that is generally cylindrical or tapered slightly from the first end to the second free end of the expandable base-engaging member. The expandable base-engaging member 224 may be solid. However, preferably, the expandable base-engaging member 224 has a hollow core 240 extending from the free end into the expandable base-engaging member 224 along the common central axis 233 of the damaged light bulb base extractor 220 that is sized in diameter and depth to accommodate the filament or other protruding pieces of a damaged light bulb when the expandable base-engaging member 224 is inserted into the base of the damaged light bulb.

The external surface 236 of the expandable base-engaging member 224 has a series of resilient ribs 260 thereon extending generally in the direction of the common central axis 233 from the first end to the second end of the expandable base-engaging member 224. The resilient ribs 260 have surface configurations whereby clockwise rotation of the expandable base-engaging member 224 with the ribs in contact with a confining generally cylindrical surface 262 of a light bulb base causes the ribs 260 to remain in a non-extended position or even move inward to facilitate such clockwise rotation of the expandable base-engaging member relative to the confining generally cylindrical surface 262 for insertion of the expandable base-engaging member into a light bulb base and counterclockwise rotation of the expandable base-engaging member 224 with the ribs in contact with a confining generally cylindrical surface 262 of a light bulb base causes the ribs 260 to move radially outward to extended positions in tighter contact with the confining generally cylindrical surface 262 of the light bulb base to better grip the confining generally cylindrical surface and facilitate the rotation of a light bulb base with the confining generally cylindrical surface 262 along with the expandable base-engaging member 224 for removal of a light bulb base gripped with the expandable base-engaging member. As shown in FIGS. 6, 7 and 14, the ribs 260 are tapered from their bases to their free ends and project outwardly and in a counterclockwise direction from the exterior surface 236 of the expandable base-engaging member. With this structure, as the expandable base-engaging member 224 is rotated clockwise in the direction shown in FIG. 6, the frictional forces generated by the movement of the ribs along interior surface 262 of the light bulb base and exerted on the outer surfaces of the ribs 260 by the interior surface 262 of the light bulb base tend to flex, move or collapse the ribs radially inward toward the exterior surface 236 of the expandable base-engaging member to facilitate insertion of the expandable base-engaging member into the base. After insertion into a base, as the expandable base-engaging member 224 is rotated counterclockwise in the direction shown in FIG. 7, the frictional forces generated by the movement of the ribs along interior surface 262 of the light bulb base and exerted on the outer surfaces of the ribs 260 by the interior surface 262 of the light bulb base tend to flex or move the ribs outward away from the exterior surface 236 of the expandable base-engaging member to expand the expandable base-engaging member into tighter engagement with the interior surface 262 of the light bulb base. Thus, the expandable base-engaging member 236 can be inserted into a light bulb base while rotating the damaged light bulb base extractor clockwise to keep the ribs 260 retracted and, once inserted, rotated counterclockwise to extend the ribs 260 to better grip the interior surface 262 of the light bulb base and unthread the base from a socket.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A damaged light bulb base extractor for removing a base of a damaged light bulb from a light bulb socket, comprising:

a handle member; the handle member having a first end and a second end;

an expandable base-engaging member for engaging and gripping an interior surface of a base of a damaged light bulb; the expandable base-engaging member being mounted on the second end of the handle member to rotate with the handle member about a common central axis extending through the handle member and the expandable base-engaging member; the expandable base-engaging member having a generally cylindrical external sidewall with a first end and a second end; the common central axis extending through the expandable base-engaging member from the first end to the second end of the expandable base-engaging member; the expandable base-engaging member being resilient whereby the application of compressive forces to the expandable base-engaging member in the direction of the central axis deforms and expands the external sidewall of the expandable base-engaging member diametrically from an unexpanded state to an expanded state in a direction perpendicular to the common central axis and release of the compressive forces returns the expandable base-engaging member to the unexpanded state; the first end of the expandable base-engaging member being contained by a first compression plate at the second end of the handle member; the second end of the expandable base-engaging member being contained by a second compression; and actuating means for moving the first and second compression plates toward and away from each other along the common central axis whereby, by moving the first and second compression plates toward each other, compressive forces are exerted by the first and second compression plates on the expandable base-engaging member to cause the external sidewall of the expandable base-engaging member to expand diametrically for engaging and gripping an interior surface of a base of a damaged light bulb so that the base may be unthreaded from a light socket by rotating the handle member counterclockwise and by moving the first and second compression plates away from each other, the compressive forces exerted by the first and second compression plates on the expandable base-engaging member are released and the expandable base-engaging member returns to the unexpanded state to enable removal of the expandable base-engaging member from a base of a damaged light bulb after the base has been removed from a light socket.

2. The damaged light bulb base extractor according to claim 1, wherein:

the expandable base-engaging member has a hollow core defined by an interior sidewall surface extending along the common central axis; and the actuating means includes a tubular connecting rod means extending through the hollow core of the expandable base-engaging member from the first end of the expandable base-engaging member to the second compression plate for moving the second compression plate toward and away from the first compression plate in the direction of the common central axis and for receiving light bulb components.

3. The damaged light bulb base extractor according to claim 2, wherein:

the interior sidewall surface has a generally concave configuration between the first and second ends of the expandable base-engaging member with a midportion of the sidewall having a reduced thickness to facilitate the expansion of the expandable base-engaging member at the midportion of the sidewall.

4. The damaged light bulb base extractor according to claim 3, wherein:

a first end of the tubular connecting rod means has a threaded opening centered on the common central axis;

a second end of the tubular connector means is integral with the second compression plate; and a drive rod means passing through the handle along the common central axis has a first end with a finger grip for turning the drive rod means clockwise and counterclockwise and a second end threaded through the threaded opening in the first end of the tubular connecting rod means for moving the second compression plate toward and away from the first compression plate by rotation of the drive rod means clockwise and counterclockwise about the common central axis.

5. The damaged light bulb base extractor according to claim 1, wherein:

the external surface of the expandable base-engaging member has a series of resilient ribs thereon extending generally in the direction of the common central axis; and the resilient ribs have surface configurations whereby clockwise rotation of the expandable base-engaging member with the ribs in loose contact with a confining generally cylindrical surface causes the ribs to remain in a non-extended position and facilitates such clockwise rotation of the expandable base-engaging member relative to the confining generally cylindrical surface for insertion of the expandable base-engaging member into a light bulb base and counterclockwise rotation of the expandable base-engaging member with the ribs in loose contact with a confining generally cylindrical surface causes the ribs to be moved radially outward to extended positions in tighter contact with the confining generally cylindrical surface to better grip the confining generally cylindrical surface and facilitate the rotation of the confining generally cylindrical surface along with the expandable base-engaging member for removal of a light bulb base gripped with the expandable base-engaging member.

6. The damaged light bulb base extractor according to claim 5, wherein:

the expandable base-engaging member has a hollow core defined by an interior sidewall surface extending along the common central axis; and the actuating means includes a tubular connecting rod means extending through the hollow core of the expandable base-engaging member from the first end of the expandable base-engaging member to the second compression plate for moving the second compression plate toward and away from the first compression plate in the direction of the common central axis and for receiving light bulb components.

7. The damaged light bulb base extractor according to claim 6, wherein:

the interior sidewall surface has a generally concave configuration between the first and second ends of the expandable base-engaging member with a midportion of the sidewall having a reduced thickness to facilitate the expansion of the expandable base-engaging member at the midportion of the sidewall.

8. The damaged light bulb base extractor according to claim 7, wherein:

a first end of the tubular connecting rod means has a threaded opening centered on the common central axis; a second end of the tubular connecting rod means is integral with the second compression plate; and a drive rod means passing through the handle along the common central axis has a first end with a finger grip for turning the drive rod means clockwise and counterclockwise and a second end threaded through the threaded opening in the first end of the tubular connecting rod means for moving the second compression plate toward and away from the first compression plate by rotation of the drive rod clockwise and counterclockwise about the common central axis.

9. The damaged light bulb extractor according to claim 1, including:

a handle extension; means for releasably connecting the handle extension to the handle member so that the handle extension and handle member rotate together whereby the length of the damaged light bulb extractor is extended for reaching light bulb sockets from a greater distance.

10. The damaged light bulb extractor according to claim 1, including:

an annular shield mounted on the handle member; the annular shield extending radially outward from the handle member to catch broken light bulb pieces loosened while removing a base of a damaged light bulb from a light bulb socket and shielding an operator from such broken light bulb pieces.

11. The damaged light bulb extractor according to claim 10, wherein:

the annular shield is releasably mounted on the handle member so that the annular shield may be removed from the handle member; and the annular shield has a generally concave annular surface for catching and retaining broken light bulb pieces.

12. A damaged light bulb base extractor for removing a base of a damaged light bulb from a light bulb socket, comprising:

a handle member; the handle member having a first end and a second end;

an expandable base-engaging member for engaging and gripping an interior surface of a base of a damaged light bulb; the expandable base-engaging member being mounted on the second end of the handle member to rotate with the handle member about a common central axis extending through the handle member and the expandable base-engaging member; the expandable base-engaging member having a generally cylindrical external sidewall with a first end and a second end; the common central axis extending through the expandable base-engaging member from the first end to the second end of the expandable base-engaging member; the external surface of the expandable base-engaging member having a series of resilient ribs thereon extending generally in the direction of the common central axis; and the resilient ribs have surface configurations whereby clockwise rotation of the expandable base-engaging member with the ribs in loose contact with a confining generally cylindrical surface causes the ribs to remain in a non-extended position and facilitates such clockwise rotation of the expandable base-engaging member relative to the confining generally cylindrical surface for insertion of the expandable base-engaging member into a light bulb base and counterclockwise rotation of the expandable base-engaging member with the ribs in loose contact with a confining generally cylindrical surface causes the ribs to be moved radially outward to extended positions in tighter contact with the confining generally cylindrical surface to expand the expandable base-engaging member to better grip the confining generally cylindrical surface and facilitate the rotation of the confining generally cylindrical surface along with the expandable base-engaging member for removal of a light bulb base gripped with the expandable base-engaging member.

13. The damaged light bulb extractor according to claim 12, including:

a handle extension; and means for releasably connecting the handle extension to the handle member so that the handle extension and handle member rotate together whereby the length of the damaged light bulb extractor is extended for reaching light bulb sockets from a greater distance.

14. The damaged light bulb extractor according to claim 12, including:

an annular shield mounted on the handle member; the annular shield extending radially outward from the handle member to catch broken light bulb pieces loosened while removing a base of a damaged light bulb from a light bulb socket and shielding an operator from such broken light bulb pieces.

15. The damaged light bulb extractor according to claim 14, wherein:

the annular shield is releasably mounted on the handle member so that the annular shield may be removed from the handle member; and the annular shield has a generally concave annular surface for catching and retaining broken light bulb pieces.

* * * * *